United States Patent [19]

Askienazy et al.

[11] 4,089,708

[45] May 16, 1978

[54] PHOSPHATATION OF METALLIC SURFACES

[75] Inventors: Alexandre Askienazy, Paris; Victor Ken, Argenteuil; Jean-Claude Souchet, Paris, all of France

[73] Assignee: Compagnie Francaise de Produits Industriels, Gennevilliers, France

[21] Appl. No.: 675,063

[22] Filed: Apr. 8, 1976

[30] Foreign Application Priority Data

Apr. 14, 1975 France ..... 75 11491

[51] Int. Cl.[2] ..... C23F 7/10

[52] U.S. Cl. ..... 148/6.15 R

[58] Field of Search ..... 148/6.15 R, 6.15 Z

[56] References Cited

U.S. PATENT DOCUMENTS

| | | | |
|---|---|---|---|
| 2,502,441 | 4/1950 | Dodd et al. | 148/6.15 R |
| 2,839,439 | 6/1958 | Stapleton | 148/6.15 R |
| 2,854,369 | 9/1958 | Kronstein | 148/6.15 R |
| 2,926,123 | 2/1960 | Simon et al. | 148/6.15 R |
| 3,247,791 | 4/1966 | Leonard | 148/6.15 R |
| 3,769,043 | 10/1973 | Morishima et al. | 148/6.15 R |
| 3,945,899 | 3/1976 | Nikaido et al. | 148/6.15 R |

FOREIGN PATENT DOCUMENTS

| | | | |
|---|---|---|---|
| 1,083,779 | 9/1967 | United Kingdom | 148/6.15 R |

*Primary Examiner*—Ralph S. Kendall

*Attorney, Agent, or Firm*—Larson, Taylor and Hinds

[57] ABSTRACT

A treatment of iron or steel surfaces to give them enhanced anti-corrosive and paint-retaining characteristics comprises the application, by spraying, dipping or otherwise, of a composition in the form of a solution of phosphates which includes an accelerating agent represented by a quantity of tungstate ion and which has a pH value in the range 5.8 to 6.5, and preferably 6.0 to 6.4.

16 Claims, No Drawings

PHOSPHATATION OF METALLIC SURFACES

The invention relates to a method and a solution for the phosphatation of metallic surfaces selected from the group consisting of iron and steel.

Phosphatation is used to enhance the resistance to corrosion of the treated metallic surfaces and also to improve the adherence to these surfaces of paints applied to the metal.

As practised it consists in coating the metallic surfaces with a layer of phosphate, the phosphate ion being introduced by a solution of metal alkaline phosphate, particularly $K^+$, $Na^+$ and $NH_4^+$.

To accomplish this the metallic surface to be phosphated is generally sprayed at a temperature of about 20° – 80° C, for a period of 1 to 3 minutes with a solution of the afore-said phosphates containing an accelerating agent.

Accelerating agents referred to in literature — both patent and scientific publications — often include molybdates and tungstates; in practice the accelerating agent generally employed is the molybdate ion, the tungstate ion being frequently cited as an equivalent by reason of the similarity between these two ions over a range of a large number of their properties, mainly due to their respective positions in the periodic classification table and the consequences which ensue therefrom.

The present inventors have been able to show that the aforementioned similarity does not apply to their behaviour as accelerating agents in the phosphatation of metallic surfaces.

In practice they have found that whilst for a satisfactory phosphatation using the molybdate ion as an accelerating agent it is useful for the phosphatation solution to have a pH of the order of 3 to 5, this is not the same when the accelerating agent is a tungstate ion; then the pH should be more than 5.8 and advantageously of the order of 6 or even as much as 6.5.

This fact has never been observed hitherto and none of the prior documents mention the aforesaid pH range in relation to the use of the tungstate ion as the accelerating agent. On the contrary, despite the fact that the said prior documents refer at large to the pH value of the phosphatation solutions being between 2 to 6, they specifically teach the range of 3 to 5, notably 3.5 to 4. This proves that in fact no serious work has previously been done with the tungstate ion with which the quality of phosphatation diminishes spectacularly when the pH value falls below 5.8. The only experiments done were those using the molybdate ion which in fact requires the above-mentioned specifically teached pH ranges to give good results. The mention in the said prior documents of a more extended range up to pH 6 quite simply arises from the fact that, naturally, the pH of phosphatation baths containing molybdate as the accelerating agent (this is moreover true for all phosphatation solutions) has a tendency to increase (this would occur under the influence of the dilution and the presence of constituents in the water causing hardness in the latter) and to tend towards pH values higher than 5.6 if nothing is been done to combat this tendency; now, having regard to the spectacular diminution of the quality of treatment obtained with molybdate baths when the pH increases above 5.6, the user prevents this increase either by the addition of phosphoric acid, or by the renewal of the solution, or otherwise.

From the foregoing it follows that despite the existence in literature of the general indication of a pH range up to the value 6, in relation to the use of phosphatation solutions containing, as an accelerating agent, the molybdate ion (beside which the citation of the tungstate ion is obviously fortuitous) the surprising and unexpected discovery by the present inventors in relation to phosphatation using the tungstate ion as the accelerating agent is novel and unobvious.

Taking the foregoing into account, the method of phosphatation in accordance with the present invention consists in subjecting the metallic surfaces which are to be phosphated to the action of a phosphatation solution containing an effective quantity of tungstate ion as the accelerating agent and having a pH value of 5.8 to 6.5, and preferably 6 to 6.4.

The invention also includes, as a new industrial product, the phosphatation solution used within the scope of the aforesaid method.

Other features and advantages of the invention are described below.

In implementing the phosphatation of metallic surfaces in accordance with the invention these metallic surfaces, if necessary after cleaning, are treated, for example sprayed, with a phosphatation solution, containing as the accelerating agent an effective quantity of tungstate ion and having a pH from 5.8 to 6.5 and preferably 6 to 6.4.

In addition to the advantages attaching to the invention referred to hereafter, it caters for considerable flexibility in use. Thus, as has been stated above, the pH of the phosphatation baths in accordance with the prior art have a tendency, because of the dilution and the presence of certain constituents of the water, to increase and to tend towards values above 5 and this has to be combated, for example by the addition of acid, so that the baths will continue to function within the necessary pH area. Having regard to the fact that the pH of phosphatation solutions in accordance with the present invention is about 6, any need for adjustment of this range is eliminated.

The temperature at which the aforesaid phosphatation solution is used is about 20° to 80° C, and the solution may advantageously contain, in addition to the phosphate ion, surfactive and detergent agents for cleaning the metallic surface and selected from the group comprising sulfonated fatty alcohols, condensates of ethylene oxide on alkyl phenols, condensates of ethylene oxide on phosphoric esters, and condensates of ethylene oxide on fatty alcohols.

These solutions may in addition contain other constituents generally present in known phosphatation solutions to the extent that the presence of these other constituents is not incompatible with the characteristics of the solutions of the present invention.

The content of tungsten ion, which is preferably introduced in the form of hydrated ammonium tungstate $(NH_4)_{10}W_{12}O_{41}$, 7 $H_2O$ or $Na_2WO_4$, 2 $H_2O$, is 0.01 to 10 g/l and preferably 0.1 to 0.3 g/l.

The duration of the treatment, when it is effected by spraying, is generally 1 to 3 minutes. Longer or shorter periods can be envisaged in accordance with the concentration of the solution and the content of tungstate.

In the case of application of the solution by dipping the subject having the surface to be treated in the solution, the duration is 2 to 5 minutes.

Operating in this way produces on the surface of the treated metallic objects coatings of excellent texture with perfect adherence to the metallic substrate, which affords very good anti-corrosive protection and a surface which is remarkably apt for anchorage of paint. The quality of the coating is characterised by the weight of the deposit per unit of surface, the texture of this deposit, which must be compact and in no way powdery, and its resistance to peeling off.

The aforesaid solutions are generally prepared from concentrated solutions which are diluted with the necessary quantity of water and adjusted in pH value, if necessary, by means of a solution of NaOH, trisodium phosphate, or of another mineral base compatible with the solution.

The invention may be even better understood by reference to the examples which are given below.

EXAMPLE 1

By dissolving the necessary quantities of the different constituents referred to below, a bath of phosphatation solution is prepared with the following composition:

Monosodium phosphate . . . . 9 g/l
Disodium phosphate . . . . 0.35 g/l
Ammonium tungstate . . . . 0.1 g/l
Condensate of 10 molecules of ethylene oxide on the nonylphenol (serving as the surfactive agent) . . . 1 g/l This bath has a pH value of 6.

Applying this solution by spraying for 3 minutes at a temperature of 60° C and at a pressure of 1.5 bars to steel test panels of 7 cm × 14 cm and 0.8 mm thickness, cut from a steel sheet of the type used in the manufacture of automobile bodies, we obtain a deposit of blue grey phosphate of a weight of 0.80 g/m² and good adherence.

EXAMPLE 2

The following concentrate is prepared:
Anhydrous monosodium phosphate . . . . 60 g
Anhydrous disodium phosphate . . . . 30 g
Ammonium tungstate . . . . 1 g
The surfactive agent described in Example 1 . . . . 9 g This concentrate is dissolved in the proportion of 10 g per liter of water. The pH value of the solution obtained is 6.3.

Test panels as used in Example 1 are subjected to a treatment by spraying with this solution for a period of 2 minutes at a temperature of 60° C and at a pressure of 1.5 bars. A uniform blue grey deposit of phosphate is obtained with a weight of 0.6 g/m² and having good adherence.

EXAMPLE 3

A concentrated solution obtained in Example 2 is dissolved in the ratio of 5 g per liter of water, this giving a phosphatation solution with a pH value of 6.4. Test panels of the type used in Example 1 are subjected to a phosphatation treatment by means of this solution, using the spraying technique, for a duration of 3 minutes at a temperature of 60° C and a pressure of 1.5 bars. This produces a uniform coating of metallic blue colour, the weight in g/m² being 0.24. This coating is adherent.

EXAMPLE 4

The following concentrate is prepared:
Anhydrous monoammonium phosphate . . . . 85.9 g
Anhydrous disodium phosphate . . . . 4.0 g
Ammonium tungstate . . . . 0.8 g
Surfactive agent described in Example 1 . . . . 9.3 g The concentrate obtained, when dissolved in the proportion of 5 g per liter of water, provides a phosphatation solution with a pH value of 6.

Steel test panels of the type identified in Example 1 are subjected to a phosphatation treatment by spraying with this solution for a period of 3 minutes at a temperature of 60° C and a pressure of 1.5 bars. The resulting test panels are found to be coated with a non-powdery phosphate blue layer with excellent adherence and having a weight of 1 in terms of g/m².

EXAMPLE 5

The following concentrate is prepared:
Anhydrous monosodium phosphate . . . . 90.2 g
Anhydrous disodium phosphate . . . . 3 g
Ammonium tungstate . . . . 0.8 g
Condensate of ethylene oxide on a fatty alcohol with a cloud point of 24° C which is sold commercially under the name "PLURAFAC CA 43" (non-foaming surfactive agent) . . . . 6 g By dissolving this concentrate in a proportion of 0.8 g per liter of water, we obtain a phosphatation solution with a pH value of 5.9.

Steel test panels of the type described in Example 1 are subjected to a phosphatation treatment by spraying with the solution at a temperature of 35° C for 2 minutes at a pressure of 1.5 bars. The test panels treated in this way have a blue coating of very high adherence qualities and a weight or density of 0.4 g/m².

EXAMPLE 6

To show the superiority of phosphatation solutions in accordance with the invention over those known in the prior art, comparative tests were made between, on the one hand, the solution described in Example 1 and, on the other hand, two commercial solutions which contain ammonium molybdate as an accelerating agent and have the following compositions:

| | Solution A | Solution B |
|---|---|---|
| Monosodium phosphate (g/l) | 8.80 | 8.80 |
| Phosphoric acid in 75% aqueous solution (g/l) | 0.14 | 0.25 |
| Sodium molybdate ($Na_2MoO_4$, $2H_2O$) (g/l) | 0.08 | 0.12 |
| Surfactive agent described in Example 1 (g/l) | 0.93 | 0.92 |

the pH value of these two compositions is respectively 5 and 4.4.

Steel test panels of the type identified in Example 1were treated by spraying with each of these three solutions for a period of 3 minutes at 60° C and under a pressure of 1.5 bars. In the case of the solution in accordance with this invention we obtained a coating of phosphate having a weight in g/m² of 0.80 as indicated above, whilst this weight was 0.55 g/m² in the case of solution A and 0.63 g/m² in the case of solution B.

If, as regards the weight of coating obtained, the values recorded for the commercial solutions are acceptable, it was found that the adherence of the coatings was superior in the case of the solution in accordance with the present invention. To show the manifest superiority in this area of the solutions in accordance with the invention, the following test was made.

The phosphated test panels rinsed and dried, were coated with a primer of automobile quality (in fact the epoxy primer No. PF 26-516 of the Duco Company) by the electro deposition technique, the final coating having a thickness of about 22 microns.

After a fresh baking the so-treated test panels are cross-scratched to bare metal and then submitted to a corrosion test of the "Salt Spray" type, Standard AFNOR NF × 41-002 with 5% NaCl, or ASTM B 117-62, for 200 hours.

After this test the panels were rinsed and dried and then scraped with a pointed tool on one side and the other of the scratch so as to remove the non-adherent paint, the results being expressed as millimeters of paint failure at one side and the other of the scratch. Under these conditions it was found that the paint on the test panels which had been phosphated in accordance with this invention was peeled away to a width of 1 mm, whilst the width of failure was 5 mm in the case of test panels treated by the two prior art solutions.

This being and irrespective of the method of realization chosen, it appears that we have evolved a method and a phosphatation solution the characteristics of which are sufficiently clear from the foregoing to make any further discussion on this subject superfluous, and which involves numerous advantages over the prior art methods and solutions of this kind, including the following:

- that of affording better qualities of adherence of the phosphate coatings which are obtained, particularly as shown by the "Salt Spray" test on scratched test panels;
- that of eliminating the problem of maintaining the pH value of the solution within the area necessary for its functioning.

We claim:

1. The method of phosphatation of metallic surfaces selected from the group consisting of iron and steel, comprising the treatment of said surfaces with an aqueous phosphatation solution containing a phosphate of a member selected from the group consisting of sodium, potassium and ammonium and an effective quantity of tungstate ion accelerating agent, and having a pH value of 5.8 to 6.5.

2. A method of phosphatation of metallic surfaces according to claim 1, in which the phosphatation solution has a pH value of 6 to 6.4.

3. A method of phosphatation in accordance with claim 2, in which the phosphatation solution used contains 0.01 to 10 g/l of ammonium tungstate or sodium tungstate.

4. A method of phosphatation in accordance with claim 2, in which the phosphatation solution used contains 0.1 to 0.3 g/l of ammonium tungstate or sodium tungstate.

5. A method of phosphatation in accordance with claim 1, in which the phosphatation solution used contains 0.01 to 10 g/l of ammonium tungstate or sodium tungstate.

6. A method of phosphatation in accorance with claim 1, in which the phosphatation solution used contains 0.1 to 0.3 g/l of ammonium tungstate or sodium tungstate.

7. A method of phosphatation in accordance with claim 1, in which the phosphatation solution is applied by spraying at a pressure of approximately 1.5 bars and at a temperature of 20 to 80° C.

8. A composition for phosphatation of metallic surfaces selected from the group consisting of iron and steel, comprising an aqueous phosphatation solution with a pH value of 5.8 to 6.5 and including a phosphate of a member selected from the group consisting of sodium, potassium and ammonium and an effective quantity of tungstate ion accelerating agent.

9. A phosphatation composition according to claim 8 which has a pH value in the range 6 to 6.4.

10. A phosphatation composition in accordance with claim 9 containing a tungstate selected from the group ammonium tungstate and sodium tungstate, in the proportion 0.01 to 10 g/l.

11. A phosphatation composition in accordance with claim 9 containing a tungstate selected from the group ammonium tungstate and sodium tungstate, in the proportion 0.1 to 0.3 g/l.

12. A phosphatation composition in accordance with claim 8 containing a tungstate selected from the group ammonium tungstate and sodium tungstate, in the proportion 0.01 to 10 g/l.

13. A phosphatation composition in accordance with claim 8 containing a tungstate selected from the group ammonium tungstate and sodium tungstate, in the proportion 0.1 to 0.3 g/l.

14. A phosphatation composition in accordance with claim 8 obtained from a concentrate by dilution in water and adjusted to said pH value by the addition of a base compatible with the solution.

15. An aqueous composition for the phosphatation of metallic surfaces selected from the group consisting of iron and steel having a pH of 6 and comprising:

Monosodium phosphate . . . . 9 g/l
Disodium phosphate . . . . 0.35 g/l
Ammonium tungstate . . . . 0.1 g/l
Condensate of 10 molecules of ethylene oxide on nonylphenyl (serving as surfactive agent) . . . 1 g/l

16. A composition for the phosphatation of metallic surfaces selected from the group consisting of iron and steel having a pH of 6.3 comprising a concentrate consisting of:

Anhydrous monosodium phosphate . . . . 60 g
Anhydrous disodium phosphate . . . . 30 g
Ammonium tungstate . . . . 1 g
Condensate of 10 molecules of ethylene oxide on nonylphenyl (as surfactive agent) . . . . 9 g dissolved in water in a ratio of 10 g concentrate per liter of water.

* * * * *